United States Patent [19]

Shelley

[11] 4,243,220

[45] Jan. 6, 1981

[54] WATER BALLOON GAME

[76] Inventor: Carlton E. Shelley, R.R. 2, Crawfordsville, Ind. 47933

[21] Appl. No.: 967,903

[22] Filed: Dec. 11, 1978

[51] Int. Cl.[2] ..... A63F 9/00

[52] U.S. Cl. ..... 273/1 R; 272/1 B

[58] Field of Search ..... 273/86 R, 236, 1 G, 273/1 R; 272/1 B

[56] References Cited

U.S. PATENT DOCUMENTS

| | | | |
|---|---|---|---|
| 1,394,277 | 10/1921 | Chester | 273/86 R |
| 3,405,941 | 10/1968 | Martell et al. | 273/86 R |
| 3,605,329 | 9/1971 | Dalli | 46/87 |
| 3,700,172 | 10/1972 | Gallegos, Sr. | 46/44 |
| 3,711,097 | 1/1973 | Begley | 46/44 |
| 3,861,684 | 1/1975 | Gastin et al. | 273/1 R |

FOREIGN PATENT DOCUMENTS

| | | | |
|---|---|---|---|
| 1101127 | 4/1955 | France | 273/86 R |

*Primary Examiner*—Richard C. Pinkham
*Assistant Examiner*—R. Carl Moy
*Attorney, Agent, or Firm*—Woodard, Weikart, Emhardt & Haughton

[57] ABSTRACT

A game device for bursting balloons with pressurized water over the players participating in the game. A plurality of balloons are suspendedly mounted over each player with the balloons being connected via water valves to a source of pressurized water. A separate water valve is provided for each player to direct pressurized water into the balloons suspended over the other players. Operation of each valve directs a small amount of water into the opposing players' balloons resulting in the eventual bursting of the balloons.

10 Claims, 5 Drawing Figures

WATER BALLOON GAME

BACKGROUND OF THE INVENTION

This invention is in the field of toys or games and more specifically those toys and games which employ pressurized water. Many toys and games have heretofore been devised which employ fluids including water during the operation of the game. For example, the U.S. Pat. No. 3,700,172 issued to Gallegos discloses a toy flying craft which is powered by directed pressurized water. A somewhat similar flying craft is disclosed in U.S. Pat. No. 3,605,329 issued to Dalli wherein the craft uses lighter-than-air gas.

The game or toy disclosed herein provides for a suspended balloon above the head of each player with the balloon above a particular player being filled with water by the repeated activation of water valves by the other players. Eventually, the particular balloon will burst thereby drenching the player therebeneath. Such a game or toy is not known to exist prior to the applicant's invention thereof although many games have been provided wherein the individual players squeeze a bulb or other similar device for movement of various objects. For example, the U.S. Pat. No. 3,711,097 issued to Begley discloses a game wherein each player is provided with an air bulb for impelling a plurality of balls toward a target.

SUMMARY OF THE INVENTION

One embodiment of the present invention is a game device for bursting a balloon by pressurized water above any one of the players playing the game comprising a stand including a base and a plurality of outwardly extending arms, each spaced a distance upwardly from the base defining player areas located beneath each of the arms, a water inlet connection on the stand connectible to a source of pressurized water, a plurality of water outlets each located on a separate arm and having means to which balloons may be mounted above the player areas to receive pressurized water, the stand including passageways leading from the outlets toward the water inlet connections, and valve means on the stand and operable disposed between the water inlet connection and the outlets to controllaby direct pressurized water through the passageways and burst one of the balloons.

Another embodiment of the present invention is a water toy comprising a post with a bottom end and a top end, a plurality of player seats connected to the bottom end of the post and extending outwardly therefrom, a plurality of arms connected to the top end of the post and extending outwardly therefrom over the seats, a water inlet on the post and connectible to a source of pressurized water, a plurality of water valves each located adjacent a separate one of the seats and connected to the water inlet, a plurality of balloon-mounting nozzles each located on a separate one of the arms with each nozzle connected to and in water communication with a number of the water valves wherein the number equals the number of the nozzles less one and wherein the water valves are operable to control water flow from the water inlet to the nozzles to burst balloons mounted thereon.

It is an object of the present invention to provide a game or toy which may be used by a plurality of players which has an object of drenching the losing player with water.

A further object of the present invention is to provide a new and improved game which uses pressurized water in the operation thereof.

In addition, it is an object of the present invention to provide a game wherein the losing players are sequentially eliminated and in the process drenched with water.

Related objects and advantages of the present invention will be apparent from the following description.

DESCRIPTION OF THE PREFERRED EMBODIMENT

Figure 1:
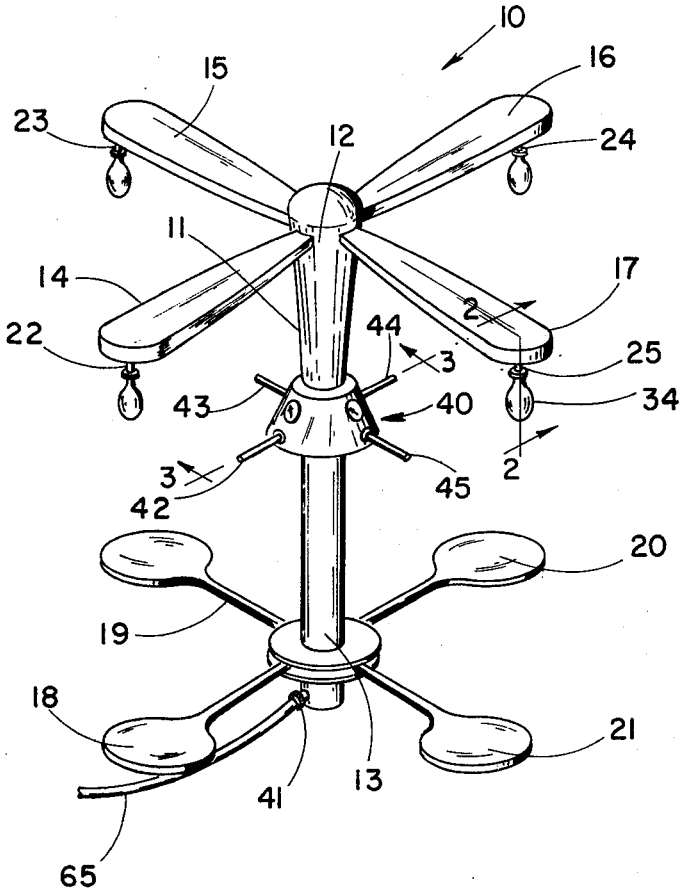
FIG. 1 is a perspective view of a game device incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a game device 10 for bursting balloons by pressurized water above any one of the players playing the game. Device 10 includes a vertical post 11 with a top end 12 and bottom end 13. A plurality of arms 14, 15, 16 and 17 are connected and mounted to the top end 12 of post 11. The arms extend horizontally outward from post 11 and are aligned with and extend over a plurality of player seats 18, 19, 20 and 21 connected and mounted to the bottom end 13 of post 11. Seats 18–21 are identical, each having a disc-shaped outer end attached to post 11 by means of an elongated member such as a rod. It is anticipated that post 11 along with the four arms 14–17 and four seats 18–21 will be produced from a lightweight material such as plastic.

Four nozzles 22–25 are mounted to and depend from, respectively, arms 14–17. Four balloons may be mounted, one each, to the nozzles which are actually water outlets connected through valves to a source of pressurized water.

Figure 2:
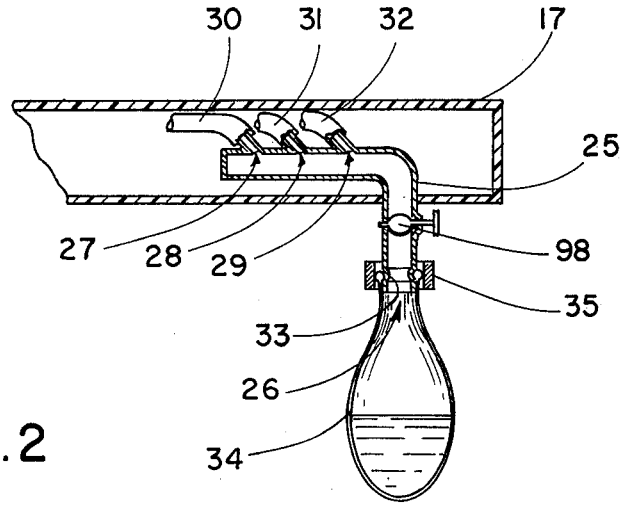
FIG. 2 is an enlarged fragmentary cross-sectional view taken along line 2—2 of FIG. 1 and viewed in the direction of the arrows.

Nozzle 25 will now be described, it being understood that a similar description to nozzles 22–24. Nozzle 25 (FIG. 2) has an elbow-configured main body having a single outlet 26 and three inlets 27–29. Each inlet 27 through 29 is formed by a tube extending outwardly from the elbow-configured main body of the nozzle with each tube being connected to conduits in turn connected through valves to a source of pressurized water. For example, conduits 30–32 are connected to the tubes forming water inlets 27–29. Nozzle 25 is mounted by suitable structure to arm 17 which houses the conduits along with the main body of the nozzle. The bottom end of nozzle 25 forming outlet 26 has a circumferentially extending groove 33 to receive the top bead-shaped ennd of balloon 34. A sleeve 35 is slidably mounted to the bottom end of nozzle 25 for securing the top end of the balloon. Sleeve 35 may be moved upwardly past groove 33 to allow for the mounting of the balloon with the sleeve then being moved downwardly so as to squeeze the top end of the balloon between sleeve 35 and the nozzle thereby securely holding the balloon in place while the balloon is filled with water resulting in the eventual burst of the balloon.

Valve means 40 is provided on vertical post 11 and is operably disposed between the water outlets 22–25 and the water inlet connection 41. Valve means 40 includes four separate valves 42 through 45 with each valve operated by a separate player positioned on seats 18–21. Valve means 40 includes a water storage tank 46 which is connected by conduit 47 (FIG. 3) in turn connected to water inlet 41.

Figure 3:
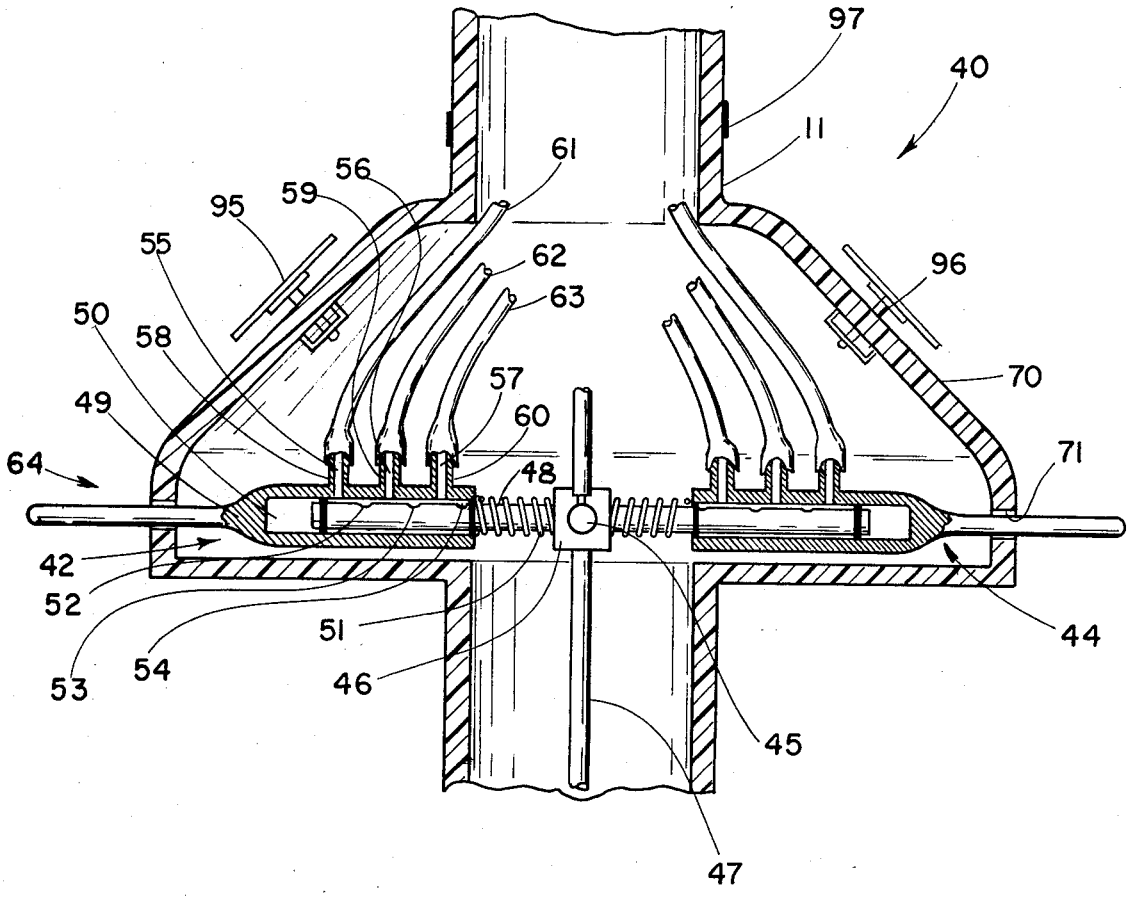
FIG. 3 is an enlarged fragmentary cross-sectional view taken along line 3—3 of FIG. 1 and viewed in the direction of the arrows.

Valve 42 will now be described, it being understood that a similar description applies to valves 43–45. Valve 42 includes a hollow tube 48 fixedly mounted to tank 46. A plunger 49 is provided with a cavity 50 slidably receiving tube 48. A helical spring 51 extending around tube 48 normally urges plunger 49 away from tank 46 with the spring being yieldable so as to allow for the alignment of apertures 52, 53 and 54, respectively, with passages 55, 56 and 57 extending through plunger 49. Passages 55 through 57 extend through, respectively, tubes 58, 59 and 60 in turn respectively connected to conduits 61, 62 and 63. Tube 48 is hollow allowing the pressurized water within tank 46 to flow into tube 48 and out through apertures 52 through 54 and into passages 55–57 to conduits 61–63. Valve 42 has a closed position when plunger 49 is in the outward direction as shown in FIG. 3 thereby preventing water from passing from tube 48 through conduits 61–63. The diameter of cavity 50 is approximately the same as the diameter of tube 48 so as to prevent flow of water through the apertures unless the plunger 49 is in the most inward position so as to provide for the alignment of the apertures with the passageways leading to conduits 61–63. In order to operate valve 42 to the open position, plunger 49 is moved in the direction of arrow 64. Likewise, the plungers on valves 43–45 may be moved inwardly thereby allowing water flow through three conduits connected to each valve leading to the nozzles previously described. A suitable source of pressurized water is connected via hose 65 (FIG. 1) which in turn is connected to water inlet 41 leading to conduit 47 and tank 46.

The nozzles depending from arms 14–17 are spaced a distance upwardly from seats 18–21 defining a player area located beneath each arm. For example, a player area is located between nozzle 22 and seat 18 with nozzle 22 positioned so as to locate the balloon attached to nozzle 22 immediately over seat 18. Likewise, valves 42–45 are located adjacent each player area or seat. For example, valve 42 is located immediately adjacent seat 18 so as to be operated by the player sitting upon seat 18. Likewise, valves 43–45 are located adjacent, respectively, seats 19–21 so as to be operated, respectively, by the players sitting upon seats 19–21. Each valve 42–45 is connected to the source of pressurized water and is operable to direct the pressurized water to three nozzles. For example, valve 42 includes three outlets connected to conduits 61–63 in turn connected, respectively, to nozzles 23–25. Thus, when the player sitting upon seat 18 depresses the plunger of valve 42, pressurized water will be directed to at least partially fill the balloons attached to nozzles 23–25 although water will not be directed to the balloon attached to nozzle 22. Likewise, the outlet conduits connected to valve 43 are in turn connected to nozzles 24, 25 and 22, the outlet conduits connected to valve 44 are connected to nozzles 25, 22 and 23 and the outlet conduits connected to valve 45 are connected to nozzles 22, 23 and 24. Thus, each valve has an open condition to direct pressurized water from the water inlet connection to water outlets on arms extending over player areas other than the player area associated with the particular valve which is in the open position. Post 11 extends outwardly forming cover 70 enclosing the valve means. Suitable holes 71 are provided to allow the plungers of each valve to extend therethrough and to prevent the plungers from disengaging the main body of the valve means.

Figure 4:
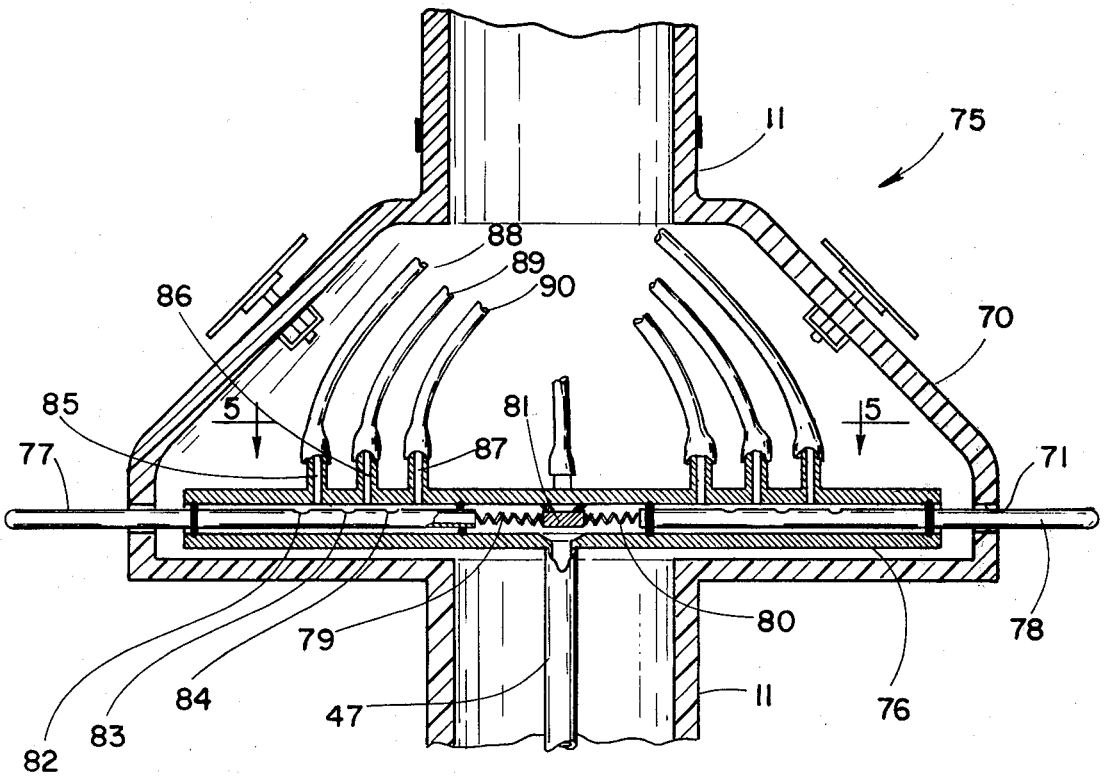
FIG. 4 is the same view as FIG. 3 only showing an alternate version of the valves for directing the pressurized water.
Figure 5:
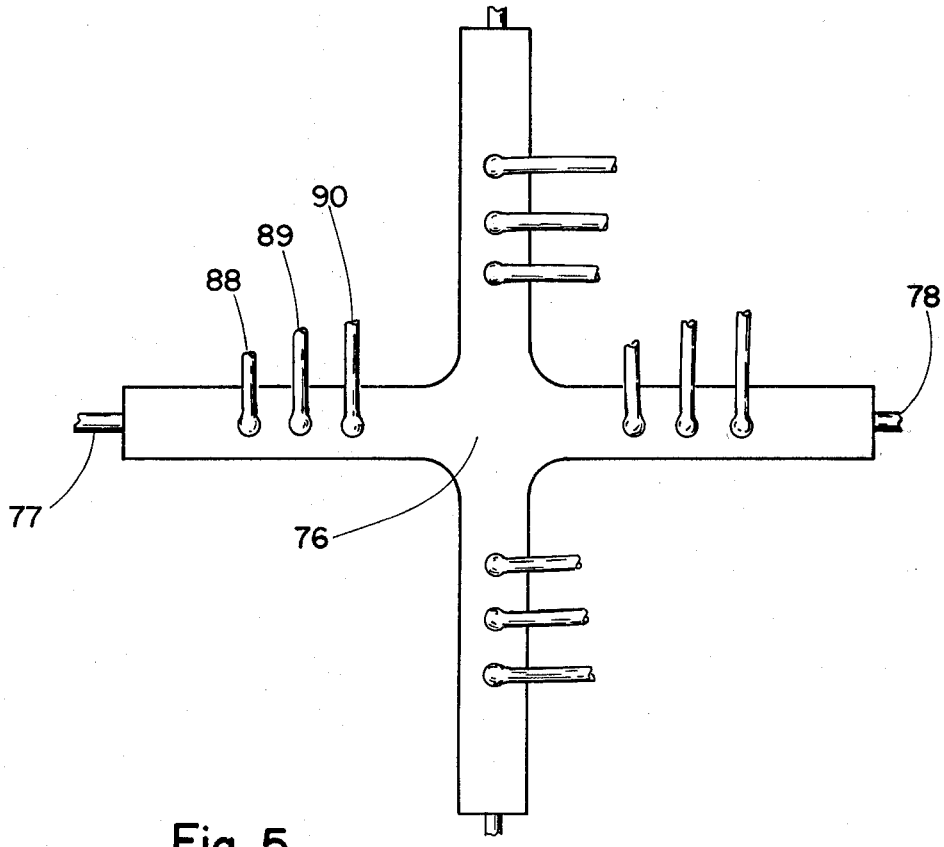
FIG. 5 is a top view of the main body of the valve means looking downwardly in the direction of the arrows intersecting line 5—5 of FIG. 4.

An alternate design of the valve means 75 is shown in FIG. 4 and is basically the same as valve means 40 with the exception that the conduits are mounted to the stationary part of the valve means and the movable plungers are provided with apertures to align with the conduits. Valve means 75 is provided with a main body 76 which is hollow and connected to conduit 47 leading to the water inlet and the source of pressurized water. Thus, the pressurized water flows into main body 76 which is configured in the shape of a cross with a separate plunger being slidably received by each arm of the cross. Two of such plungers 77 and 78 are shown in FIG. 4 and are slidably received by main body 76 being urged to their most outward position by helical springs 79 and 80 positioned between the inner ends of the plungers and a movable block 81 fixedly attached to main body 76. The inner ends of the plungers are provided with suitable apertures to allow the pressurized water to flow into the plungers and out through apertures when the plungers are in the most inward position. For example, plunger 77 is provided with apertures 82, 83 and 84 which are aligned with passages provided in tubes 85, 86 and 87 when the plunger is in the inward position. Passages 85 through 87 are connected, respectively, to conduits 88–90 which in turn are connected to the outlet nozzles provided on the three arms other than the arm beneath which is located plunger 77.

A spinnable dial is located on the cover enclosing the valve means immediately adjacent and above each plunger. For example, spinnable dials 95 and 96 (FIG. 3) are rotatably mounted to post 11 with a suitable line or mark 97 located immediately above each spinnable wheel. In order to play the game disclosed herein, hose 65 is first connected to a source of pressurized water with the four players then sitting upon seats 18–21. The first player then spins his dial located above the plunger adjacent his seat. The spinnable dial is provided with numbers such as 1, 2 or 3, one of which will be aligned with mark 97 once the spinning dial has stopped. The player then depresses his particular plunger equal to the number of times shown on the dial aligned with mark 97. For example, if the number 2 on the dial is aligned with mark 97, then the player depresses the plunger twice. Two bursts of water will then be directed to the other three players' balloons so as to partially fill the balloons. Each player in turn spins his dial and depresses his plunger the appropriate number of times shown by the dial until eventually one of the balloons bursts. The eventual winner is determined when three of the four balloons have burst, thereby drenching the losing players.

If only two players are playing in lieu of four, then the flow of water may be shut off to the nozzles above the two vacant seats. A butterfly valve 98 (FIG. 2) is rotatably mounted in the main body of the nozzle and may be operated from a closed position to an open position. When in the closed position, the butterfly valve 98 will prevent the flow of water from the nozzle. Thus, if two players are sitting on seats 18 and 20 with seats 19 and 21 vacant, then the butterfly valves may be turned to the closed position on nozzles 23 and 25.

It will be noted that the game includes four separate balloon-mounting nozzles although it is to be understood that the present invention contemplates a number greater than or less than four nozzles. Each nozzle is connected to a number of water valves wherein the number of water valves equals the number of nozzles less one.

In one embodiment of the game device disclosed herein, the balloons are located 48 inches from the ground with the conduits being approximately one-quarter inch diameter. While a variety of balloons may be used with the game device, at least one type of balloon will burst when it is filled to a length of approximately 16 inches. A typical four-year old when seated extends approximately 20 inches above ground whereas an eight-year old when seated extends approximately 26 inches above ground thereby providing for ample space between the seat and the arm when the balloon is located approximately 48 inches above ground.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A game device for bursting a balloon by pressurized water above any one of the players playing the game comprising:

a stand including a base and a plurality of outwardly extending arms, each spaced a distance upwardly from said base defining player areas located beneath and substantially vertically aligned with each of said arms;

a water inlet connection on said stand connectible to a source of pressurized water;

a plurality of water outlets each located on a separate one of said arms and having surfaces to which balloons may be mounted above said player areas to receive pressurized water, said stand including passageways leading from said outlets toward said water inlet connections; and valve means on said stand and operably disposed between said water inlet connection and said outlets to controllably direct pressurized water through said passageways and burst at least one of said balloons.

2. The device of claim 1 wherein:

said valve means includes a plurality of valves with each operated by a separate player at a separate player area, each valve has an open condition to direct pressurized water from said water inlet to water outlets on arms extending over player areas other than said separate player area associated with a valve in said open condition.

3. The device of claim 2 wherein:

said valve means includes a storage tank connected to said water inlet connection, each valve includes a hollow tube and sleeve slidably mounted together and extending outwardly from said tank, said sleeve includes conduits leading therefrom to said water outlets, said tube includes a plurality of apertures alignable with said conduit when said valve is in said open condition to direct water from said tank through said tube and out said apertures and conduits to said water outlets.

4. The device of claim 3 wherein:

said sleeves are fixedly mounted to said tank and said tubes are slidably mounted to said sleeves.

5. The device of claim 3 wherein:

said tubes are fixedly mounted to said tank and said sleeves are slidably mounted to said tubes.

6. The device of claim 3 wherein:

said stand includes a post connecting together said arms and said base which includes a separate player seat located beneath each arm to position a player beneath a balloon mounted to a water outlet.

7. The device of claim 3 and further comprising:

means connected to certain of said water outlets to stop water flow through certain water outlets even though any one of said valves are in said open condition.

8. A water toy comprising:

a post with a bottom end and a top end;

a plurality of player seats connected to said bottom end of said post and extending outwardly therefrom;

a plurality of arms connected to said top end of said post and extending outwardly therefrom over said seats;

a water inlet on said post and connectible to a source of pressurized water;

a plurality of water valves each located adjacent a separate one of said seats and connected to said water inlet;

a plurality of balloon-mounting nozzles each located on a separate one of said arms with each nozzle connected to and in water communication with a number of said water valves wherein sid number of equals the number of said nozzles less one and wherein said water valves are operable to control water flow from said water inlet to said nozzles to burst balloons mounted thereon.

9. The water toy of claim 8 wherein:

said water valves are each operated by a separate player at a separate player area, each valve has an open condition to direct pressurized water from said water inlet to said nozzles.

10. The water toy of claim 9 wherein:

said water valves include a water storage tank connected to said water inlet, each valve includes a hollow tube and sleeve slidably mounted together and extending outwardly from said tank, said sleeve includes conduits leading therefrom to said nozzles, said tube includes a plurality of apertures alignable with said conduits when said valve is in the open condition to direct water from said tank through said tubes and out said apertures to said nozzles.

* * * * *